US008757085B1

(12) United States Patent
Cain

(10) Patent No.: US 8,757,085 B1
(45) Date of Patent: Jun. 24, 2014

(54) REINFORCED BOAT HULL

(76) Inventor: Matthew D. Cain, Eudora, KS (US)

( * ) Notice: Subject to any disclaimer, the term of this patent is extended or adjusted under 35 U.S.C. 154(b) by 245 days.

(21) Appl. No.: 13/093,673

(22) Filed: Apr. 25, 2011

Related U.S. Application Data

(60) Provisional application No. 61/446,272, filed on Feb. 24, 2011.

(51) Int. Cl.

| | |
|---|---|
| ***B63B 3/00*** | (2006.01) |
| ***B63B 3/09*** | (2006.01) |
| ***B63B 3/26*** | (2006.01) |
| ***B63B 3/28*** | (2006.01) |
| ***B63B 3/36*** | (2006.01) |
| ***B63B 3/70*** | (2006.01) |
| *B63H 7/02* | (2006.01) |

(52) U.S. Cl.
USPC ..... 114/356; 114/63; 114/355; 440/37

(58) Field of Classification Search
USPC ..... 114/63, 65 R, 74 A, 79 R–79 W, 85, 114/355–359; 440/37
See application file for complete search history.

(56) References Cited

U.S. PATENT DOCUMENTS

| | | | | |
|---|---|---|---|---|
| 2,082,836 | A * | 6/1937 | Kjekstad | 114/79 W |
| 2,322,160 | A * | 6/1943 | Schlagel | 114/356 |
| 3,048,858 | A * | 8/1962 | Leisen | 114/356 |
| 3,064,283 | A * | 11/1962 | Swanson | 114/356 |
| 3,179,961 | A * | 4/1965 | Ward et al. | 114/363 |
| 3,943,586 | A * | 3/1976 | Palmer | 114/356 |
| 5,199,368 | A * | 4/1993 | Souda | 114/65 R |
| 6,056,608 | A * | 5/2000 | Phelan, Sr. | 440/37 |

FOREIGN PATENT DOCUMENTS

| | | | | |
|---|---|---|---|---|
| JP | 2002331988 | A * | 11/2002 | B63B 5/24 |
| SU | 613947 | A * | 6/1978 | B63B 5/20 |

OTHER PUBLICATIONS

Photograph of airboat on sale prior to Feb. 24, 2010; Photograph of airboat hull on sale prior to Feb. 24, 2010.
Photograph of reinforced hull design on sale before the date of invention of the present application.

* cited by examiner

*Primary Examiner* — Ajay Vasudeva
(74) *Attorney, Agent, or Firm* — Erikson, Kernell, Derusseau & Kleypas, LLC

(57) ABSTRACT

A reinforced hull for a flat-bottomed boat comprises a bottom panel having longitudinal and lateral braces extending across an upper surface of the bottom panel of the hull. The braces are formed from channel members having outwardly and downwardly sloping legs connected together by a web. The lateral braces have notches formed in and extending upward from bottom edges of the legs with each notch sized to receive a longitudinal brace therein. Lower, outer corners of the bow are reinforced and an engine stand is welded to the brace assembly.

9 Claims, 7 Drawing Sheets

8
3
1
11
6
12
13
2

87
76
78
83
85
79
42
85
77
81
3
45

REINFORCED BOAT HULL

CROSS-REFERENCE TO RELATED APPLICATIONS

This application claims the benefit of U.S. provisional patent application Ser. No. 61/446,272, filed Feb. 24, 2011, under 35 U.S.C. §119(e).

BACKGROUND OF THE INVENTION

Field of the Invention

The present invention relates to a novel welded aluminum pyramidal grid system and welded engine stand integrated into an ice capable multi-mission boat hull design. Ice related operations require hull internal and external integrated designs capable of surviving the harsh environment ice provides.

SUMMARY OF THE INVENTION

A reinforced hull for a flat-bottomed boat comprises a bottom panel having a first set of braces extending in parallel spaced relation across at least a portion of an upper surface of the bottom panel and a second set of braces extending in parallel spaced relation and transverse to the first set of braces. The braces are formed from channel members having outwardly and downwardly sloping legs connected together by a web. The second set of braces have notches formed in and extending upward from bottom edges of the legs with each notch sized to receive a first brace therein so that the second braces can be set over the first braces and the brace assembly is then welded in place to the bottom panel of the reinforced hull. In a preferred embodiment, the first set of braces extend longitudinally across the bottom panel and the second set of braces extend laterally across the bottom panel.

Side gunnels are welded to and extend upward from the bottom panel. A lazarette bulkhead extends across the bottom panel and between the side gunnels, separating a passenger compartment from an engine mounting compartment extending behind said passenger compartment. A bow bulkhead extends across the bottom panel and between the side gunnels separating the passenger compartment from a bow or bow compartment An engine stand comprising an engine support frame mounted on support legs is welded to the brace assembly. The engine stand support legs are preferably welded to the lazarette bulkhead for further reinforcement.

The reinforced hull is preferably shaped so that the side gunnels extending between the bow bulkhead and the lazarette bulkhead extend in generally parallel relationship and the side gunnels extending forward from the bow bulkhead slope inward toward a bow end of the hull. Corners of the reinforced hull formed in the bow between the bottom panel and the side gunnel panels proximate the bow bulkhead are reinforced with a reinforcing plate welded to an inner surface thereof.

The portion of the bottom panel running across the bottom of the passenger compartment and the engine compartment may be referred to as the keel plate. The portion of the bottom panel extending from the bow bulkhead forward may be referred to as the bow plate. The keel plate includes a longitudinal bend on each side to initiate the forming of the sides for an all welded reinforced mating of the side-gunnel panels. A one-piece transom is solidly welded in place to secure the aft side-gunnels and keel pate together to form the aft section of the boat. The bow plate is a single rolled sheet welded to the keel plate with side gunnels welded thereto and corners formed between the bow plate and side gunnels just in front of the bow bulkhead or the passenger compartment reinforced.

Internally the hull shell is reinforced with longitudinal pyramidal ribs and frames welded together to produce a strong and rigid grid system that runs from the transom plate to the very bow of the boat as well as up the sides. Hull and bow gussets, transom rib supports, reinforced corner bow plates, an all-welded engine stand, bulkheads in the lazarette and bow complete the structure designed to allow for superior reinforcement of the boat hull in extreme ice contact conditions.

DETAILED DESCRIPTION OF THE PREFERRED EMBODIMENTS

Figure 1:
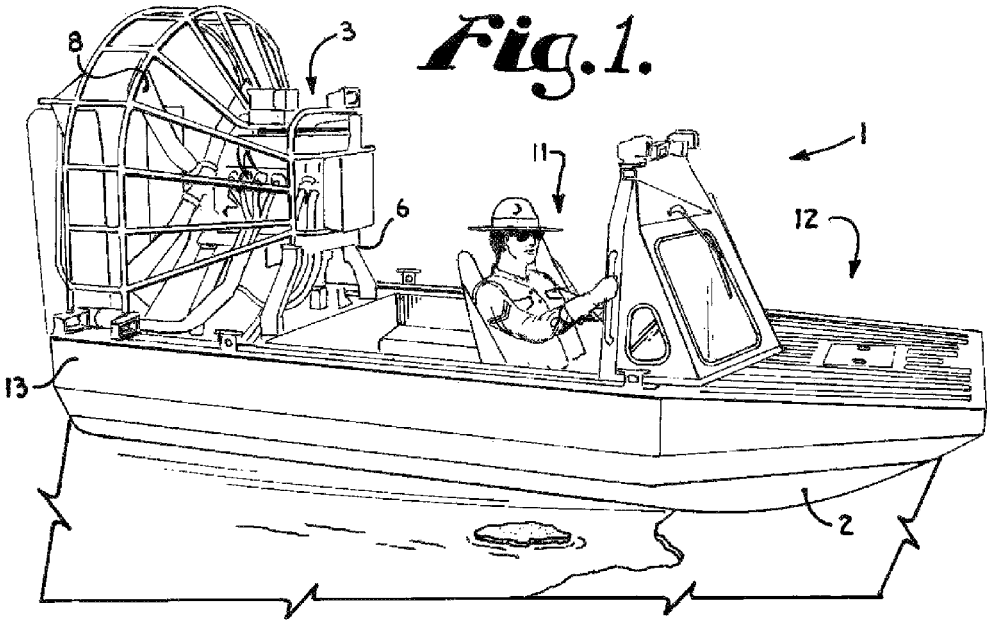
FIG. 1 is a perspective view of a flat bottomed boat shown advancing onto a frozen portion of a body of water.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. The drawings constitute a part of this specification and include exemplary embodiments of the present invention and illustrate various objects and features thereof.

Certain terminology will be used in the following description for convenience in reference only and will not be limiting. For example, the words "upwardly," "downwardly," "rightwardly," and "leftwardly" will refer to directions in the drawings to which reference is made. The words "inwardly" and "outwardly" will refer to directions toward and away from, respectively, the geometric center of the embodiment being described and designated parts thereof. Said terminology will include the words specifically mentioned, derivatives thereof and words of a similar import.

Figure 10:
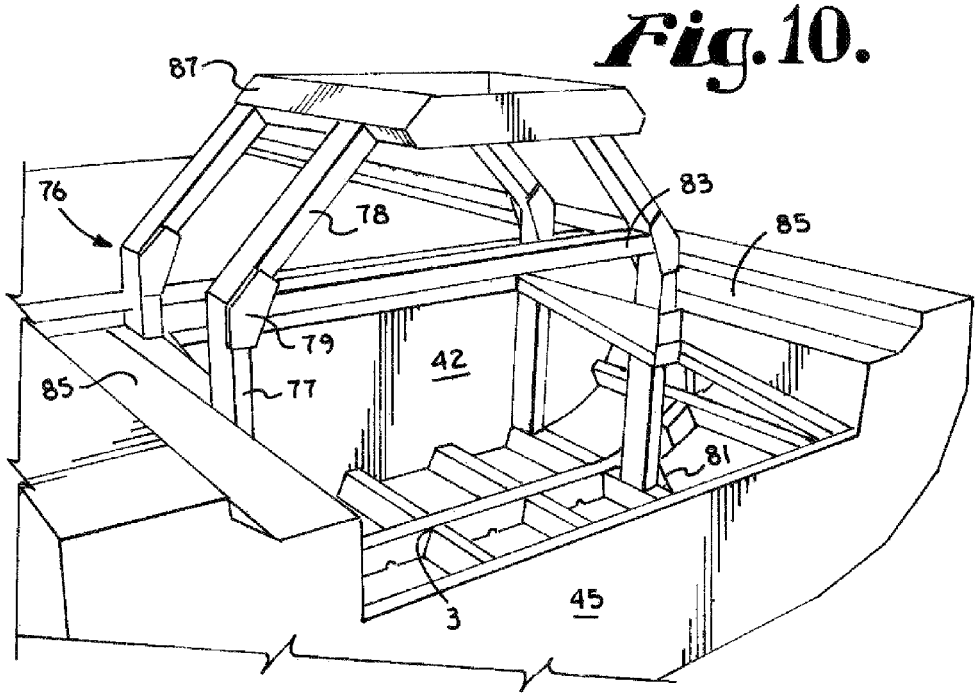
FIG. 10 is a fragmentary, rear perspective view of the reinforced hull of the flat bottom boat showing an engine mounting stand welded into place in an engine compartment at the rear of the hull.

Referring to the drawings in more detail, reference numeral 1 refers to a boat having a flat bottomed hull or hull shell 2 which is reinforced by a reinforcing grid or brace assembly 3 in a manner described hereafter to permit breaking through or traveling across ice on a frozen body of water without significant damage to the hull 2. The boat 1 shown is an air-boat. It is to be understood that the reinforced hull could be used with flat bottomed boats propelled by other means such as conventional outboard motors. The air-boat 1 includes an engine 4 mounted on an engine stand 6 and driving an impeller 8 for moving air to propel the boat 1 forward. As best seen in FIG. 10, the engine stand 6 is welded to and projects upward from the reinforcing grid assembly 3.

Figure 2:
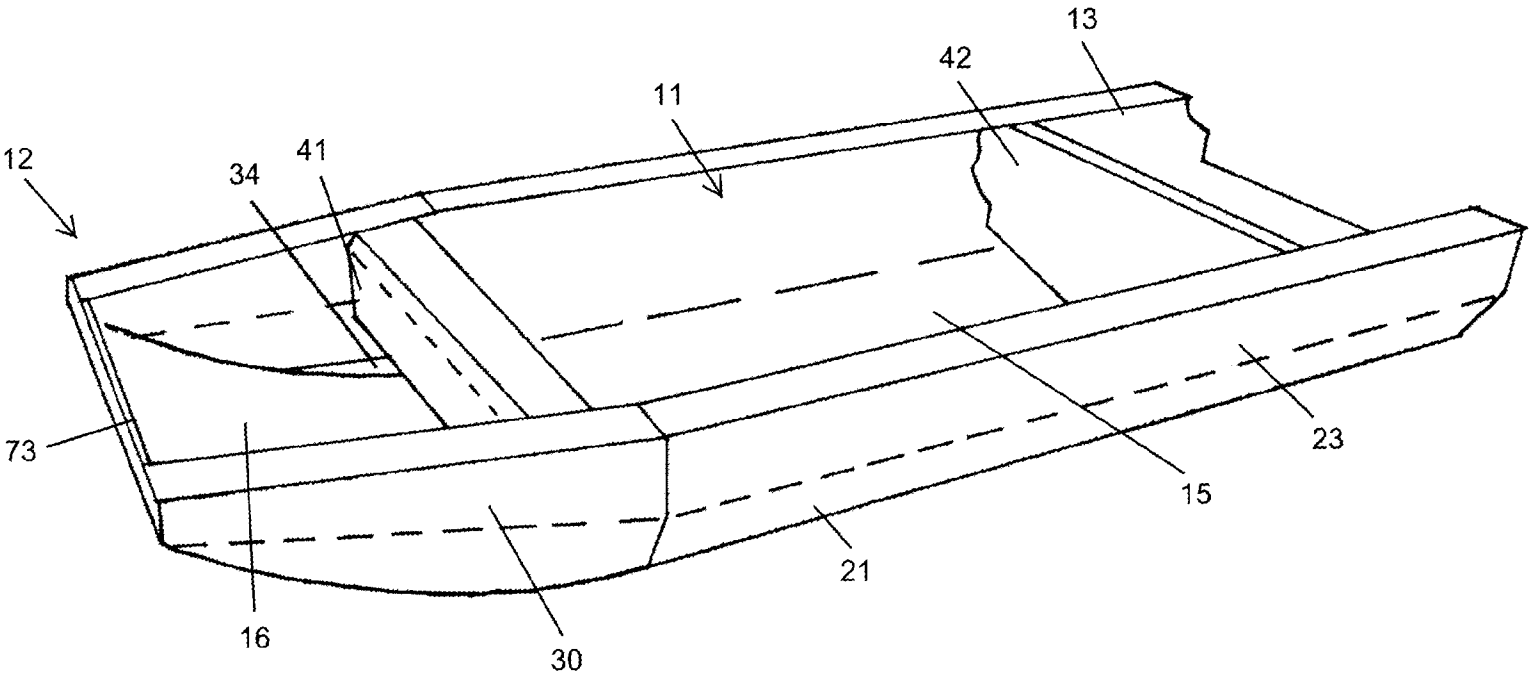
FIG. 2 is a perspective view of a reinforced hull of the flat bottomed boat shown in FIG. 1 with a bracing assembly removed to show detail.
Figure 3:
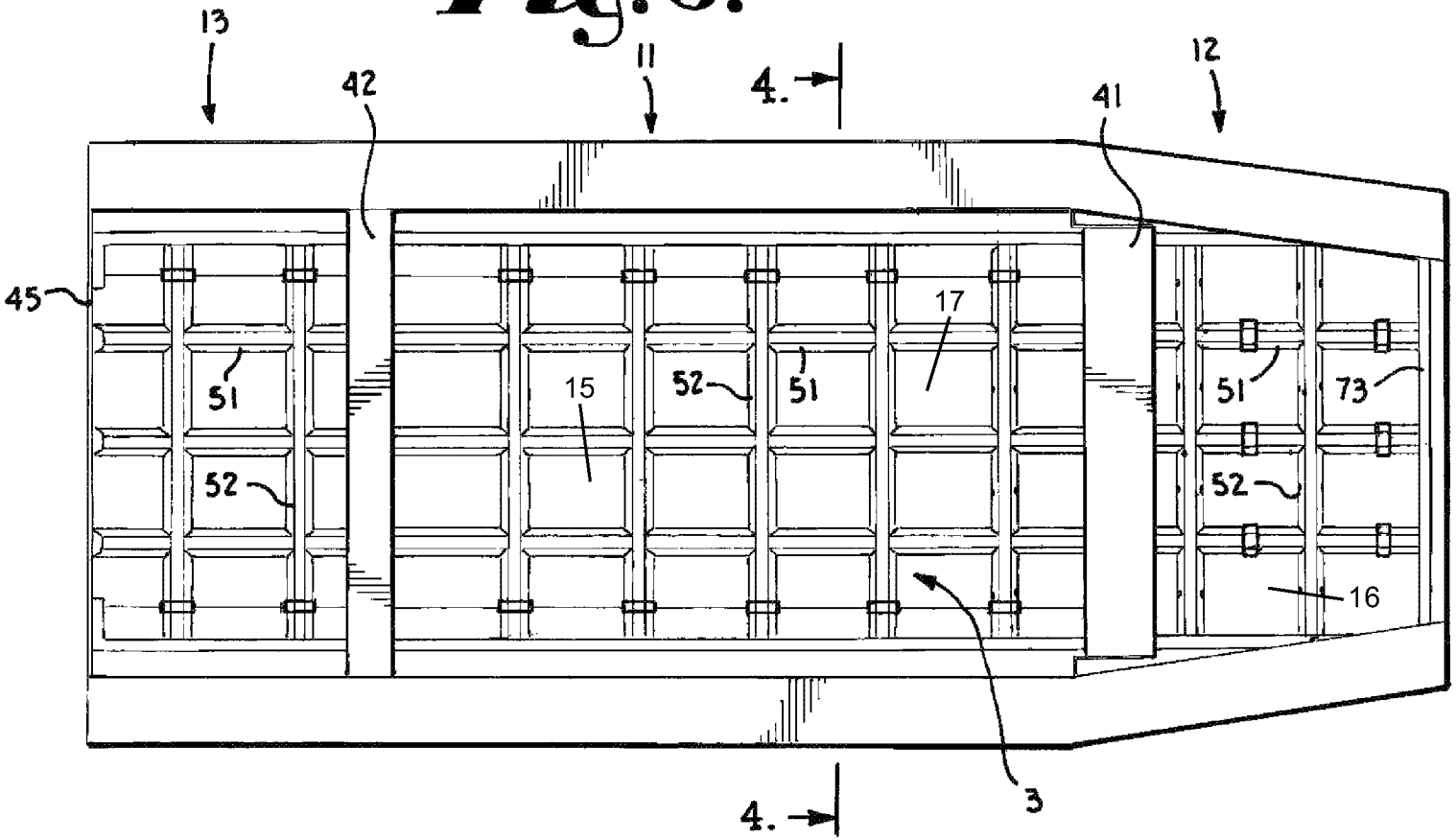
FIG. 3 is a top plan view of the reinforced hull showing the bracing assembly welded therein and with the number of longitudinal braces shown reduced for purposes of clarity.
Figure 5:
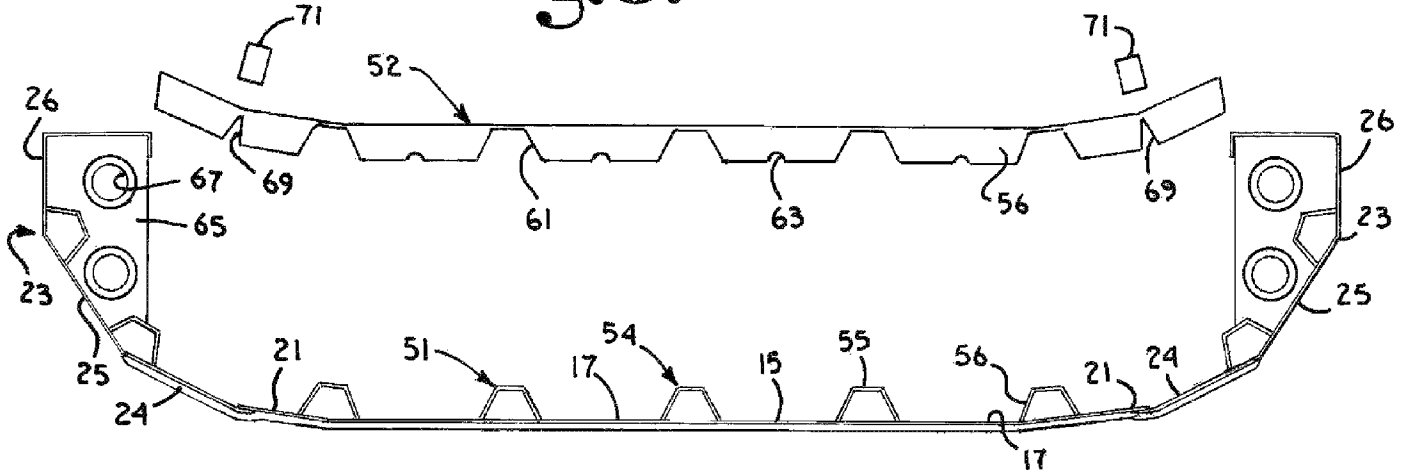
FIG. 5 is an exploded cross-sectional view similar to FIG. 4, showing a lateral brace separated from the longitudinal braces and with support straps also separated therefrom.
Figure 4:
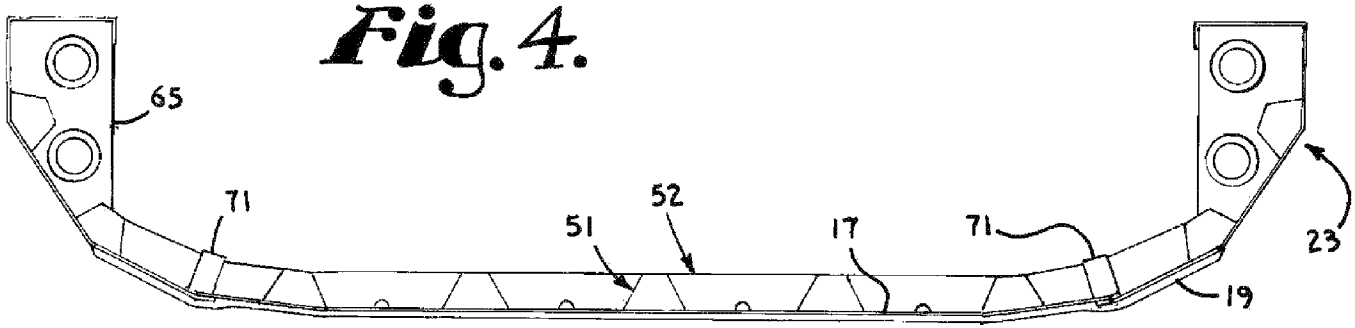
FIG. 4 is a cross sectional view of the reinforced hull taken generally along line 4-4 of FIG. 3 with the full number of longitudinal braces incorporated into a preferred embodiment shown.
Figure 6:
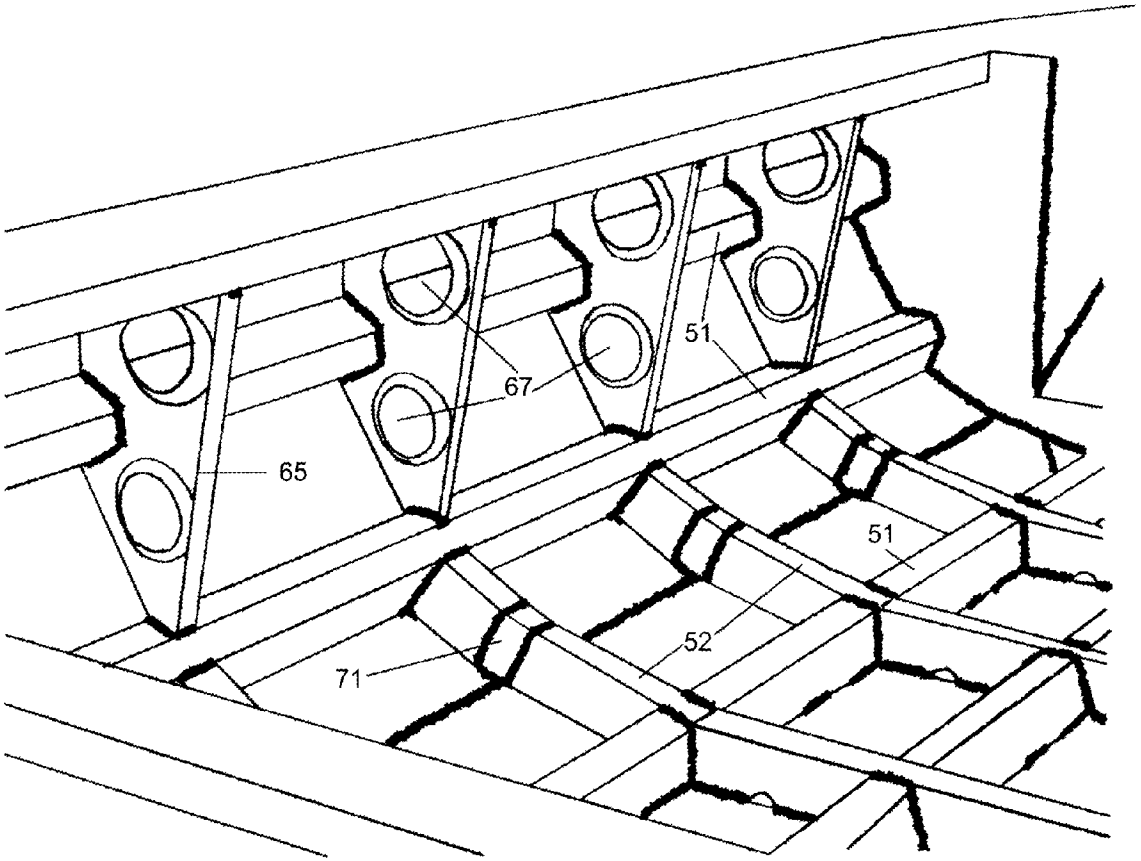
FIG. 6 is an enlarged and fragmentary perspective view showing a side of a passenger compartment of the reinforced hull.
Figure 7:
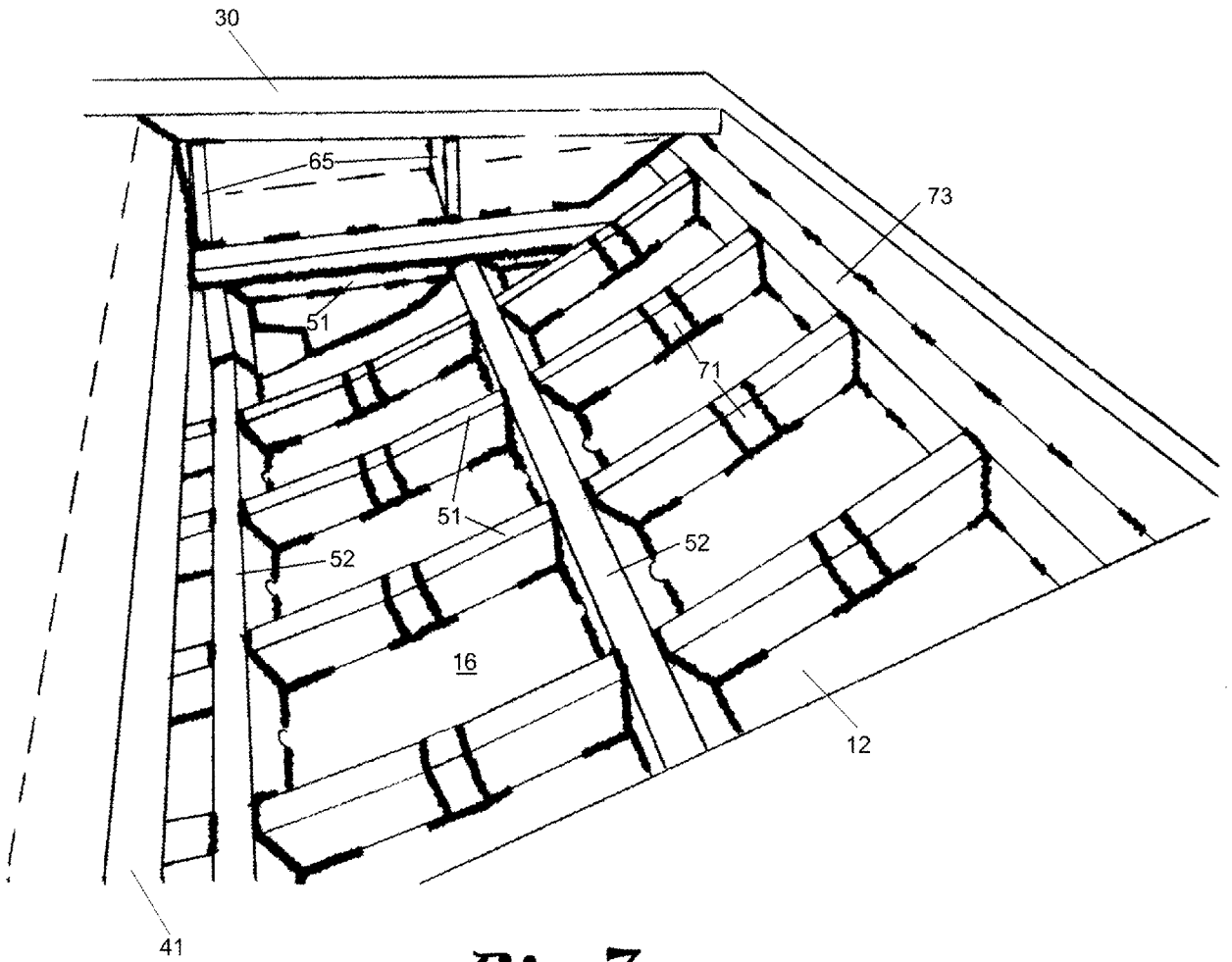
FIG. 7 is an enlarged and fragmentary perspective view showing the bow portion of the reinforced hull.
Figure 8:
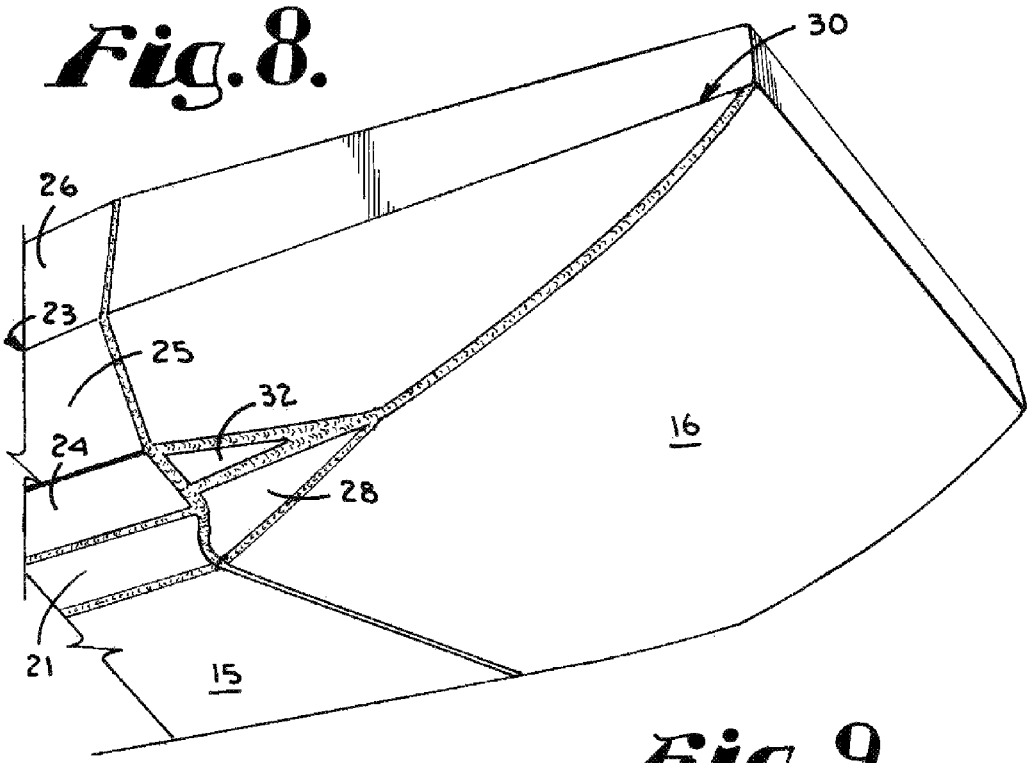
FIG. 8 is a fragmentary perspective view of the bottom of the reinforced hull.

FIG. 2 is a perspective view of the boat hull 2 with decking, flooring and the reinforcing grid assembly 3 removed. FIG. 3 is a stop plan view of the hull 2 showing the reinforcing, interlocking brace assembly 3. The boat 1 and its hull 2 can generally be described as comprising three sections, an operator section or compartment 11, a bow section 12 projecting forward of the operator section 11 and a lazarette or engine mounting section 13 behind the operator section 11. As best seen in FIG. 3, the hull 2 includes a keel plate 15 and a bow plate 16 which are welded together with a butt weld to form a flat bottom or bottom panel 17 of the hull 2. The keel plate 15 forms the bottom or bottom panel of the hull 2 along the operator section 11 and lazarette 13. The bow plate 16 slopes upward from the keel plate 15 toward the front end of the boat and forms the bottom or bottom panel of the hull 2 along the bow section 12. As shown in cross-section in FIGS. 4 and 5, a layer of rigid plastic sheeting 19 may be bolted or otherwise secured to the bottom of the keel plate 15 and bow plate 16 to function as a replaceable wear surface. The plastic sheeting 19 may be formed of a plastic having a relatively low coefficient of friction to facilitate movement of the boat 1 over ice.

Outer segments or panels 21 on each side of the keel plate 15 are bent upwards at an acute angle relative to horizontal and side-gunnel panels 23 are welded thereto with a lap weld. Each side gunnel panel 23 includes lower, middle, and upper wall segments 24, 25 and 26 respectively. The lower wall segment 24 is welded to an outer panel 21 of the keel plate 15 both inside and out producing an overlapping welded seam or joint between the keel plate 15 and the lower wall segment 24 of the side gunnel panel 23. The lower wall segment 24 angles inward from the keel plate outer panel 21, the middle wall segment 25 angles inward from the lower wall segment 24 and the upper wall segment angles inward from the middle wall segment 25 such that the upper wall segment 26 extends generally perpendicular to the keel plate 15.

Figure 9:
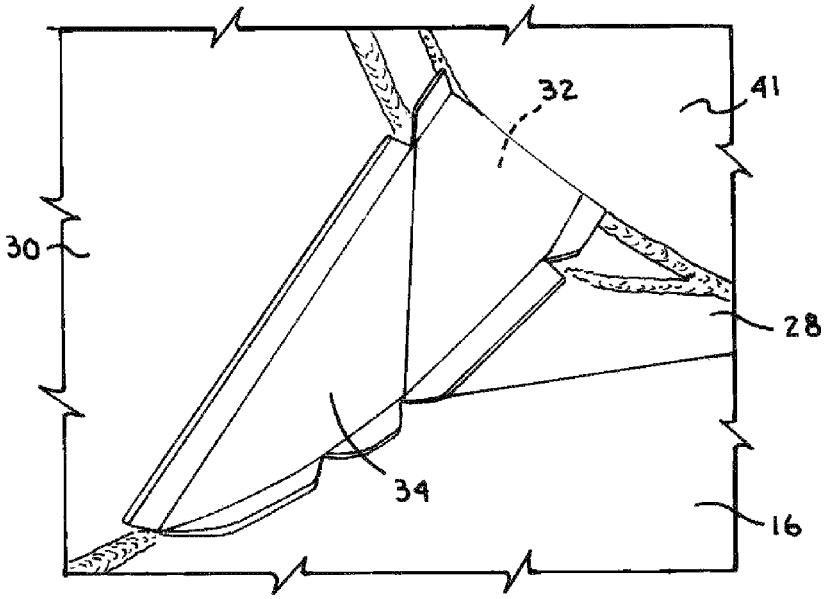
FIG. 9 is an enlarged and fragmentary view of an interior of the bow section of the reinforced hull showing a reinforcing plate positioned therein prior to welding.

Installation and welding of the bow plate 16 is accomplished by abutting the bow plate 16 against the end of the keel plate 15, allowing the angled sides or outer strips 21 of the keel plate 15 to protrude forward a few inches. Corner sections 28 of the bow plate 16 adjacent the angled outer panels 21 of keel plate 15, are bent to conform to the angle of the outer panels 21 of the keel plate 16. Side-gunnels 30 are welded to the bow plate 16 and project upward therefrom. A lower corner segment 32 of each side gunnel 30 is bent inward relative to the side gunnel 30 to conform to the angle of the lower wall segment 24 of side gunnel 23 attached to the keel plate 16. Bow corner reinforcing plates 34 are welded to inner surfaces of either or both of the lower corner segment 32 of the bow side gunnel 30 or the corner section 28 of the bow plate 16 to reinforce the hull 2 at leading corner surfaces 36 and 37 between the bow section 12 and the operator compartment 11. FIG. 9 shows a single, bent reinforcing plate 34 welded to the inner surface of a lower corner segment 32 of a bow side gunnel 30 and the corner section 28 of the bow plate 16.

The width of the keel plate 15 and the spacing between the side gunnel panels 23 is generally constant so that the operator section 11 and engine mounting section 13 are generally rectangular. The bow plate 16 narrows from the keel plate 15 toward the outer end thereof such that the bow section 12 of the hull 2 tapers outward from the leading edge of the bow 16 toward the operator section 11, from the operator section rearward, the hull 2 is generally straight walled. The reinforced leading corner surfaces 36 and 37 create a relative short wedge facilitate breaking of the ice and directing the broken ice to the side of the boat 1. Existing airboats generally taper outward from bow to stern creating a long wedge shape, which is prone to damage as a boat is wedged further into the ice. Installation of the bow plate 16 in this manner allows for a stronger ice breaking zone between the bow section 12 and operator section 11 and reduces channeling and improves operational control of the boat 1 in slush, broken, thin or rough ice conditions.

Hull reinforcement is also provided by front and rear watertight bulkheads 41 and 42 located between the operator and bow sections 11 and 12 and the operator and engine compartment sections 11 and 13 respectively. The front bulkhead 41 is welded in place along a leading edge of the keel plate 15 between the side gunnel panels 23. The rear bulkhead 42 is welded in place across the keel plate 15 and between the side gunnel panels 23 at a point of intersection between the operator section 11 and the engine mounting section 13. The front bulkhead 41 generally separates the bow section 12 from the operator section 11 and the rear bulkhead 42 projects the operator section 11 from the lazarette 13. When flooring or decking is installed over the interlocking grid system 3 in each section 11-13 of the boat 1, the covered space forms a watertight, airtight compartment which should prevent the boat from sinking if swamped or the like. Transom or transom plate 45 is welded to the keel plate 15 and the side gunnel panels 23 across the back of the hull 2.

The interlocking grid assembly 3 is comprised of longitudinal ribs 51 and interlocking frames 52 to produce an extremely strong supporting structure or grid. The frames 52 may also be referred to as lateral braces. An interlocking grid assembly 3 is welded to the inner surface of the hull 2 in each of the operator section 11, bow section 12 and lazarette 13. The longitudinal ribs 51 and interlocking frames 52 are preferably formed from channel members 54 having a web 55 interconnecting spaced apart legs 56 which slope outwardly away from the web 55. The channel members 54 may be referred to as pyramidal channel members and when welded in place present an isosceles trapezoid cross-section. Longitudinal ribs 51 are laid out longitudinally along an inner surface of the bow plate 16 and the keel plate 15 from the outer ends of the bow section 12 and the lazarette 13 and welded in place with the outer edges 58 of the channel member legs 56 abutting against the bow plate 16 or keel plate 15. The number of ribs 51 used will depend on the width of the keel plate 15, the size of the channel members 54 used and the amount of structural support desired. It is to be understood that the size of the channel members 54 used in a boat 1 may vary depending on where the rib 51 is to be placed and whether greater support is desired at selected positions. Longitudinal ribs 51 may also be secured to the side gunnels 23 such as along the bend between the lower and middle wall segments 24 and 25 and along the bend between the middle and upper wall segments 25 and 26 as shown. For sake of clarity in some the drawings, the number of longitudinal ribs shown secured to the keel plate 15 varies.

The locking or lateral frames 52 shown, are similarly formed from the pyramidal channel members 54 having aligned sets of notches 61 formed in the legs 56 and extending upward and inward from the leg outer edges 58 towards an up to the web 55. Aligned pairs of notches 61 are sized to receive a longitudinal rib 51 therein so that the notched locking frames 52 may be positioned over and interlocked with the longitudinal ribs 51 such that the web 55 of the frame 52 abuts against the web 55 of the longitudinal rib 51. The frame 52 is then welded to the ribs 51 to produce the grid assembly 3. Welds are formed on the top and shoulders of each rib 51 and frame 52 intersection to produce a rigid structure. It is to be understood that the ribs 51 and frames 52 could be welded together before welding the assembly to the keel plate 15 or bow plate 16. Each frame 52 preferably has a plurality of passages 63 in the shape of a half-circle formed in the leg outer edges 58 for water transport under the floor if required.

As with the longitudinal ribs 51, the number of interlocking frames 52 used can and will vary depending in part on the size of the hull 2. In the operator and lazarette sections 11 and 13 of the hull 2, the frames 52 are sized to extend from and between the ribs 51 extending along the transition from the keel plate 15 and the side gunnel panels 23. Outer ends of the frames 52 are welded to an inner leg 56 of the ribs 51. Gussets or gusset plates 65 are welded on the inside of each side gunnel panel 23 and extend from the ribs 51 along the bend between the lower and middle wall segments 24 and 25 to an upper end of the side gunnel 23 such that the gussets 65 and frames 52 interlocked with ribs 51 tie the side gunnels 23 to the keel plate 15. Not only is the bottom of the boat strengthened with the grid assembly 3, but so are the side structures. The side gunnel panels 23 are bent as a single piece and wrapped or formed around the gussets 65, therefore allowing for welding completely around the gussets 65 to the sides for maximum strength and support. Each gusset 65 has a pair of dimpled or flared holes 67 in the vertical web to increase the strength of each gusset 65.

In the operator and lazarette sections 11 and 13 of the hull 2, the lateral frames 52 must be bent near their outer ends to conform to the bend in the keel plate 15 along its outer panels or sections 21. The frames 52 are bent but first cutting slots 69 in the frame legs 56 and bending the web 55 of the frame above the slot 69. After the frame 52 is welded in place, a strap 71 formed from a short section of channel member 54 is welded to the frame 52 over aligned slots 69 in opposed legs 56 and welded to the keel plate 15 for strengthening the frames 51 at the bends. The longitudinal ribs 51 in the bow section 12 are similarly bent and reinforced with a strap to bend the rib 51 to conform to the curvature of the bow plate 16.

The grid assembly 3 in the bow section 12 is constructed similarly to the grid systems in the operator and lazarette sections 11 and 13. The bow grid system 3 is formed from longitudinal ribs 51 and lateral, interlocking frames 52 and is bent to conform to the shape of the bow plate 16. The bow section 12 also includes gusset plates 65 of reduced height welded into the bow side gunnels 30 and to lateral frames 52.

At the front of the bow section 12, each longitudinal rib 51 abuts against or is capped with an aluminum angle which is welded in place along the very top and front of the bow plate 5 and likewise welded into the forward bulkhead 9. Again this provides added strength and resistance to ice deforming or seriously affecting the bow while pushing or breaking through ice. Half circle passageways are also included in the legs 56 of the lateral frames 52 in the bow section 12 to allow for drainage or movement of any water that may enter the bow section 12. Water is then removed by opening a plug in the very bottom of the front bulkhead 41 for removal by sump.

As shown in FIG. 10 the engine stand 6 is welded into the lazarette section 13 and onto the grid assembly 3 welded to the keel plate 15. Engine stand legs 76 formed from heavy gauge rectangular aluminum tubing are welded to and project upward from longitudinal ribs 51. Each leg 76 includes a vertical segment 77 and an inwardly angled segment 78. Weld plates 79 are placed over angled intersections of the vertical and inwardly angled segments 77 and 78 to produce strong joints and welds to prevent movement of the stand 6 under the pressure of use. Leading edges of the two forward-most legs 76 are welded to the rear surface of the lazarette bulkhead 42. Gussets 81 are welded between the longitudinal ribs 51 and the vertical segments 77 of the legs 76 for additional support. A cross-brace 83 formed from rectangular tubing extends between the rearward-most legs 76 at the upper ends of the vertical segments 77. To further strengthen the installation each leg 76 is also welded to a lazarette deck panel 85 formed on the upper end of the side gunnel panels 23 to produce an extremely rigid mount. Weld points in the gunnel area are also strengthened with the longitudinal rib 11 in the very side of the hull. An engine platform 87 is welded to the upper ends of the legs 76 and the engine 4 is supported on the platform 87.

The hull 2 includes a complete bow to aft interlocking grid system 3 integrated into the operator section 11 the bow section 12 and the lazarette or engine mounting stand section 13. All the components solidly welded together produce a solid and rigid hull structure capable of surviving all sorts of ice conditions from slush to wind generated ice ridges without collapsing the hull sides or the bow intersection with the keel. Reinforced corner bow plates and a unique angled keel to bow interface also provide for excellent command and control of the boat without ice channeling in thin or broken ice.

It is to be understood that while certain forms of the present invention have been illustrated and described herein, it is not to be limited to the specific forms or arrangement of parts described and shown. As used in the claims, identification of an element with an indefinite article "a" or "an" or the phrase "at least one" is intended to cover any device assembly including one or more of the elements at issue. Similarly, references to first and second elements is not intended to limit the claims to such assemblies including only two of the elements, but rather is intended to cover two or more of the elements at issue. Only where limiting language such as "a single" or "only one" with reference to an element, is the language intended to be limited to one of the elements specified, or any other similarly limited number of elements.

Having thus described the invention, what is claimed as new and desired to be secured by Letters Patent is as follows:

1. A reinforced hull for a flat-bottomed boat comprising:

a) a bottom panel;

b) a bow plate connected to said bottom panel and extending forward of said bottom panel at an upward angle relative to said bottom panel;

c) a plurality of first braces extending in parallel spaced relation across at least a portion of an upper surface of said bottom panel and at least a portion of an upper surface of said bow plate, said first braces being formed from a channel member having outwardly and downwardly sloping legs;

d) a plurality of second braces extending in parallel spaced relation and transverse to said first braces; said second braces being formed from a channel member having outwardly and downwardly sloping legs and having notches formed in and extending upward from bottom edges of said legs, each said notch sized to receive a first brace therein;

e) said first braces welded to said bottom panel and said bow plate, and said second braces welded to said bottom panel, said bow plate and said first braces.

2. The reinforced hull as in claim 1 wherein said first braces extend longitudinally relative to said bottom panel and said second braces extend transverse to said first braces.

3. A reinforced hull for a flat-bottomed boat comprising:

a) a passenger compartment comprising a rectangular keel plate having a bottom panel and outer panels bent inward and upward from said bottom panel and passenger side gunnels connected to and extending upward from said keel plate outer panels;

b) a bow comprising a bow plate connected to and extending forward of said keel plate and bow side gunnels connected to and extending upward from said bow plate, and a corner panel formed between said bow plate and each said bow side gunnels, each said corner panel angled inward toward said bow plate and sloping upwards towards a front of said reinforced hull; and c) a reinforcing plate welded to said corner panel on an inner surface thereof.

4. A reinforced hull for a flat-bottomed boat comprising:

a) a bottom panel and side gunnels connected to and extending upward from said bottom panel;

b) a lazarette bulkhead extending across said bottom panel and between said side gunnels and separating a passenger compartment from an engine mounting compartment extending behind said passenger compartment;

c) a bow bulkhead extending across said bottom panel and between said side gunnels and separating said passenger compartment from a bow;

d) a brace assembly comprising a plurality of longitudinal braces extending in parallel spaced relation across said bottom panel in each of said bow, said passenger compartment and said engine mounting compartment; said longitudinal braces formed from a channel member having outwardly and downwardly sloping legs and a plurality of lateral braces extending in parallel spaced relation and transverse to said longitudinal braces; said lateral braces formed from a channel member having outwardly and downwardly sloping legs and having notches formed in and extending upward from bottom edges of said legs, each said notch sized to receive a longitudinal brace therein; said longitudinal braces welded to said bottom panel and said lateral braces welded to said bottom panel and said longitudinal braces; and e) an engine stand comprising an engine support frame mounted on supports welded to said brace assembly.

5. The reinforced hull as in claim 4 wherein said supports for said engine stand are welded to said lazarette bulkhead.

6. The reinforced hull as in claim 4 wherein said side gunnels extending between said bow bulkhead and said lazarette bulkhead extend in generally parallel relationship; and said side gunnels extending from said bow bulkhead slope inward toward a bow end of said hull.

7. The reinforced hull as in claim 4 wherein corners formed in said bow between said bottom panel and said side gunnels proximate said bow bulkhead are reinforced with a reinforcement plate welded to an inner surface thereof.

8. The reinforced hull as in claim 4 wherein said lateral braces interconnect said side gunnels.

9. A reinforced hull for a flat-bottomed boat comprising:

a) a passenger compartment comprising a rectangular keel plate having a bottom panel and outer panels bent inward and upward from said bottom panel and passenger side gunnels connected to and extending upward from said keel plate outer panels;

b) a bow comprising a bow plate connected to and extending forward of said keel plate and bow side gunnels connected to and extending upward from said bow plate, and a corner panel formed between said bow plate and said bow side gunnels adjacent said keel plate;

c) a reinforcing plate welded to said corner panel on an inner surface thereof;

d) a plurality of first braces extending in parallel spaced relation across at least a portion of an upper surface of said bottom panel, said first braces being formed from a channel member having outwardly and downwardly sloping legs;

e) a plurality of second braces extending in parallel spaced relation and transverse to said first braces; said second braces being formed from a channel member having outwardly and downwardly sloping legs and having notches formed in and extending upward from bottom edges of said legs, each said notch sized to receive a first brace therein; and f) said first braces welded to said bottom panel and said second braces welded to said bottom panel and said first braces.

* * * * *